US008147681B2

(12) United States Patent
Yeggy et al.

(10) Patent No.: US 8,147,681 B2
(45) **Date of Patent: *Apr. 3, 2012**

(54) SEPARATING COMPOSITIONS

(75) Inventors: Robert C Yeggy, West Chester, OH (US); Vito J Altavilla, Cincinnatti, OH (US)

(73) Assignee: Vary Petrochem, LLC, Brooklyn, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/953,037

(22) Filed: Nov. 23, 2010

(65) Prior Publication Data

US 2011/0062369 A1 Mar. 17, 2011

Related U.S. Application Data

(63) Continuation of application No. 12/765,982, filed on Apr. 23, 2010, now Pat. No. 7,867,385, which is a continuation of application No. 11/868,031, filed on Oct. 5, 2007, now Pat. No. 7,749,379.

(60) Provisional application No. 60/828,501, filed on Oct. 6, 2006.

(51) Int. Cl.
*C09K 3/00* (2006.01)

(52) U.S. Cl. ..... 208/390

(58) Field of Classification Search ..... 208/390
See application file for complete search history.

(56) References Cited

U.S. PATENT DOCUMENTS

| | | | |
|---|---|---|---|
| 3,331,896 | A | 7/1967 | Eiseman et al. |
| 3,547,803 | A | 12/1970 | Jorda et al. |
| 3,644,194 | A | 2/1972 | Keely et al. |
| 3,660,268 | A | 5/1972 | Kelly et al. |
| 3,933,651 | A | 1/1976 | Erskine |
| 3,935,076 | A | 1/1976 | Cymbalisty |
| 3,948,754 | A | 4/1976 | McCollum et al. |
| 3,951,749 | A | 4/1976 | Fairbanks, Jr. et al. |
| 3,951,778 | A | 4/1976 | Willard, Sr. |
| 3,967,777 | A | 7/1976 | Canevari |
| 3,969,220 | A | 7/1976 | Anderson et al. |
| 3,978,925 | A | 9/1976 | Redford |
| 3,984,920 | A | 10/1976 | Raymond et al. |
| 3,985,684 | A | 10/1976 | Arey, Jr. et al. |
| 3,986,557 | A | 10/1976 | Striegler et al. |
| 3,986,592 | A | 10/1976 | Baillie et al. |
| 3,992,285 | A | 11/1976 | Hutchings |
| 3,994,341 | A | 11/1976 | Anderson et al. |
| 3,997,426 | A | 12/1976 | Montagna et al. |
| 4,008,765 | A | 2/1977 | Anderson et al. |
| 4,019,575 | A | 4/1977 | Pisio et al. |
| 4,019,578 | A | 4/1977 | Terry et al. |
| 4,024,915 | A | 5/1977 | Allen |
| 4,028,222 | A | 6/1977 | Prull |
| 4,036,732 | A | 7/1977 | Irani et al. |
| 4,046,668 | A | 9/1977 | Farcasiu et al. |
| 4,046,669 | A | 9/1977 | Blaine et al. |
| 4,048,078 | A | 9/1977 | Allen |
| 4,052,293 | A | 10/1977 | Mercer et al. |
| 4,054,505 | A | 10/1977 | Hart, Jr. et al. |
| 4,054,506 | A | 10/1977 | Hart, Jr. et al. |
| 4,057,485 | A | 11/1977 | Blaine et al. |
| 4,067,796 | A | 1/1978 | Alford et al. |
| 4,068,716 | A | 1/1978 | Allen |
| 4,068,717 | A | 1/1978 | Needham |
| 4,071,433 | A | 1/1978 | Hanson |
| 4,098,674 | A | 7/1978 | Rammler et al. |
| 4,108,760 | A | 8/1978 | Williams et al. |
| 4,110,194 | A | 8/1978 | Peterson et al. |
| 4,115,246 | A | 9/1978 | Sweany |
| 4,120,775 | A | 10/1978 | Murray et al. |
| 4,120,776 | A | 10/1978 | Miller et al. |
| 4,127,170 | A | 11/1978 | Redford |
| 4,127,172 | A | 11/1978 | Redford et al. |
| 4,127,475 | A | 11/1978 | Farcasiu et al. |
| 4,133,382 | A | 1/1979 | Cram et al. |
| 4,139,450 | A | 2/1979 | Hanson et al. |
| 4,140,182 | A | 2/1979 | Vriend |
| 4,151,073 | A | 4/1979 | Comolli |
| 4,161,442 | A | 7/1979 | Audeh et al. |
| 4,174,263 | A | 11/1979 | Veatch et al. |
| 4,189,376 | A | 2/1980 | Mitchell |
| 4,197,183 | A | 4/1980 | Audeh |
| 4,213,862 | A | 7/1980 | Davis et al. |

(Continued)

FOREIGN PATENT DOCUMENTS

| | | |
|---|---|---|
| CA | 326747 | 10/1932 |

(Continued)

OTHER PUBLICATIONS

European Patent Office Communication pursuant to Article 94(3) EPC, regarding Application No. 07871125.6-2104, dated Mar. 18, 2010.

(Continued)

*Primary Examiner* — Walter D Griffin
*Assistant Examiner* — Brian McCaig
(74) *Attorney, Agent, or Firm* — Benesch Friedlander Coplan & Aronoff LLP

(57) ABSTRACT

A water-based separating composition for separating hydrocarbons from hydrocarbon containing material includes at least about 73% by weight water, a hydrotropic agent, a dispersant having flocculating characteristics, at least one acid and at least one base in amounts sufficient to provide the separating composition with a pH of about 7 to about 8.5. The hydrotropic agent and the dispersant having flocculating characteristics are different.

45 Claims, No Drawings

U.S. PATENT DOCUMENTS

| | | | |
|---|---|---|---|
| 4,224,138 | A | 9/1980 | Kruyer |
| 4,229,281 | A | 10/1980 | Alquist et al. |
| 4,236,995 | A | 12/1980 | Kruyer |
| 4,240,377 | A | 12/1980 | Johnson |
| 4,240,897 | A | 12/1980 | Clarke |
| 4,242,195 | A | 12/1980 | Rudnick |
| 4,249,604 | A | 2/1981 | Frazier |
| 4,250,016 | A | 2/1981 | Estes et al. |
| 4,250,017 | A | 2/1981 | Reale |
| 4,273,191 | A | 6/1981 | Hradel |
| 4,280,559 | A | 7/1981 | Best |
| 4,284,360 | A | 8/1981 | Cymbalisty et al. |
| 4,293,035 | A | 10/1981 | Fitch |
| 4,302,051 | A | 11/1981 | Bass et al. |
| 4,302,326 | A | 11/1981 | Bialek |
| 4,312,761 | A | 1/1982 | Gitchel et al. |
| 4,333,529 | A | 6/1982 | McCorquodale |
| 4,337,143 | A | 6/1982 | Hanson et al. |
| 4,338,185 | A | 7/1982 | Noelle |
| 4,341,619 | A | 7/1982 | Poska |
| 4,342,639 | A | 8/1982 | Gagon |
| 4,342,657 | A | 8/1982 | Blair, Jr. |
| 4,343,691 | A | 8/1982 | Minkkinen |
| 4,344,839 | A | 8/1982 | Pachkowski et al. |
| 4,347,118 | A | 8/1982 | Funk et al. |
| 4,347,126 | A | 8/1982 | McGarry et al. |
| 4,357,230 | A | 11/1982 | Sibley et al. |
| 4,358,373 | A | 11/1982 | Jubenville |
| 4,361,476 | A | 11/1982 | Brewer |
| 4,368,111 | A | 1/1983 | Siefkin et al. |
| 4,383,914 | A | 5/1983 | Kizior |
| 4,385,982 | A | 5/1983 | Anderson |
| 4,387,016 | A | 6/1983 | Gagon |
| 4,396,491 | A | 8/1983 | Stiller et al. |
| 4,399,038 | A | 8/1983 | Yong |
| 4,399,039 | A | 8/1983 | Yong |
| 4,401,552 | A | 8/1983 | Elanchenny et al. |
| 4,409,090 | A | 10/1983 | Hanson et al. |
| 4,409,091 | A | 10/1983 | Kessick |
| 4,410,417 | A | 10/1983 | Miller et al. |
| 4,414,194 | A | 11/1983 | Blytas |
| 4,421,638 | A | 12/1983 | Kukes et al. |
| 4,424,113 | A | 1/1984 | Mitchell |
| 4,425,227 | A | 1/1984 | Smith |
| 4,427,066 | A | 1/1984 | Cook |
| 4,427,528 | A | 1/1984 | Lindorfer et al. |
| 4,428,824 | A | 1/1984 | Choi et al. |
| 4,429,744 | A | 2/1984 | Cook |
| 4,429,745 | A | 2/1984 | Cook |
| 4,437,998 | A | 3/1984 | Yong |
| 4,446,012 | A | 5/1984 | Murthy et al. |
| 4,450,911 | A | 5/1984 | Shu et al. |
| 4,456,065 | A | 6/1984 | Heim et al. |
| 4,456,533 | A | 6/1984 | Seitzer |
| 4,457,827 | A | 7/1984 | Chung et al. |
| 4,466,485 | A | 8/1984 | Shu |
| 4,470,899 | A | 9/1984 | Miller et al. |
| 4,473,461 | A | 9/1984 | Thacker et al. |
| 4,474,616 | A | 10/1984 | Smith et al. |
| 4,484,630 | A | 11/1984 | Chung |
| 4,486,294 | A | 12/1984 | Miller et al. |
| 4,489,782 | A | 12/1984 | Perkins |
| 4,489,783 | A | 12/1984 | Shu |
| 4,498,958 | A | 2/1985 | Bialek |
| 4,503,910 | A | 3/1985 | Shu |
| 4,508,172 | A | 4/1985 | Mims et al. |
| 4,510,257 | A | 4/1985 | Lewis et al. |
| 4,510,997 | A | 4/1985 | Fitch et al. |
| 4,511,000 | A | 4/1985 | Mims |
| 4,511,479 | A | 4/1985 | Fuller et al. |
| 4,512,872 | A | 4/1985 | Chung et al. |
| 4,514,283 | A | 4/1985 | Closemann et al. |
| RE31,900 | E | 5/1985 | Halverson |
| 4,519,894 | A | 5/1985 | Walker |
| 4,521,292 | A | 6/1985 | Spars et al. |
| 4,521,293 | A | 6/1985 | Scinta et al. |
| 4,529,496 | A | 7/1985 | Kruyer |
| 4,532,024 | A | 7/1985 | Haschke et al. |
| 4,533,459 | A | 8/1985 | Dente et al. |
| 4,536,279 | A | 8/1985 | Audeh |
| 4,539,093 | A | 9/1985 | Friedman et al. |
| 4,539,096 | A | 9/1985 | Rudnick |
| 4,539,097 | A | 9/1985 | Kelterborn et al. |
| 4,557,821 | A | 12/1985 | Lopez et al. |
| 4,561,965 | A | 12/1985 | Minkkinen |
| 4,565,249 | A | 1/1986 | Pebdani et al. |
| 4,578,181 | A | 3/1986 | Derouane et al. |
| 4,582,593 | A | 4/1986 | Bialek |
| 4,587,006 | A | 5/1986 | Minden |
| 4,588,476 | A | 5/1986 | Warzel |
| 4,595,239 | A | 6/1986 | Ayler et al. |
| 4,596,651 | A | 6/1986 | Wolff et al. |
| 4,597,443 | A | 7/1986 | Shu et al. |
| 4,597,852 | A | 7/1986 | York et al. |
| 4,603,115 | A | 7/1986 | Schweighardt |
| 4,606,812 | A | 8/1986 | Swanson |
| 4,607,699 | A | 8/1986 | Stephens |
| 4,615,796 | A | 10/1986 | Kramer |
| 4,620,592 | A | 11/1986 | Perkins |
| 4,620,593 | A | 11/1986 | Haagensen |
| 4,635,720 | A | 1/1987 | Chew |
| 4,637,992 | A | 1/1987 | Lewis et al. |
| 4,651,826 | A | 3/1987 | Holmes |
| 4,652,342 | A | 3/1987 | Kuerston |
| 4,660,645 | A | 4/1987 | Newlove et al. |
| 4,671,801 | A | 6/1987 | Burgess et al. |
| 4,675,120 | A | 6/1987 | Martucci |
| 4,676,312 | A | 6/1987 | Gussow |
| 4,676,908 | A | 6/1987 | Ciepiela et al. |
| 4,679,626 | A | 7/1987 | Perkins |
| 4,683,029 | A | 7/1987 | Oyler et al. |
| 4,692,238 | A | 9/1987 | Bodle et al. |
| 4,695,373 | A | 9/1987 | Ho |
| 4,699,709 | A | 10/1987 | Peck |
| 4,704,200 | A | 11/1987 | Keane |
| 4,719,008 | A | 1/1988 | Sparks et al. |
| 4,721,560 | A | 1/1988 | York et al. |
| 4,724,068 | A | 2/1988 | Stapp |
| 4,730,671 | A | 3/1988 | Perkins |
| 4,738,795 | A | 4/1988 | Farnand |
| 4,741,835 | A | 5/1988 | Jacques et al. |
| 4,747,920 | A | 5/1988 | Muralidhara et al. |
| 4,761,391 | A | 8/1988 | Occelli |
| 4,765,885 | A | 8/1988 | Sadeghi et al. |
| 4,783,268 | A | 11/1988 | Leung |
| 4,786,368 | A | 11/1988 | York et al. |
| 4,812,225 | A | 3/1989 | Corti et al. |
| 4,817,185 | A | 3/1989 | Yamaguchi et al. |
| 4,818,370 | A | 4/1989 | Gregoli et al. |
| 4,818,373 | A | 4/1989 | Bartholic et al. |
| 4,822,481 | A | 4/1989 | Taylor |
| 4,856,587 | A | 8/1989 | Nielson |
| 4,857,496 | A | 8/1989 | Lopez et al. |
| 4,875,998 | A | 10/1989 | Rendall |
| 4,880,528 | A | 11/1989 | Westhoff et al. |
| 4,882,041 | A | 11/1989 | Scott et al. |
| 4,888,108 | A | 12/1989 | Farnand |
| 4,906,355 | A | 3/1990 | Lechnick et al. |
| 4,912,971 | A | 4/1990 | Jeambey |
| 4,929,341 | A | 5/1990 | Thirumalachar et al. |
| 4,952,306 | A | 8/1990 | Sawyer et al. |
| 4,952,544 | A | 8/1990 | McCauley |
| 4,961,467 | A | 10/1990 | Pebdani |
| 4,966,685 | A | 10/1990 | Hall et al. |
| 4,968,412 | A | 11/1990 | Guymon |
| 4,970,190 | A | 11/1990 | Lopez et al. |
| 4,981,579 | A | 1/1991 | Paspek et al. |
| 4,988,427 | A | 1/1991 | Wright |
| 4,993,490 | A | 2/1991 | Stephens et al. |
| 4,994,172 | A | 2/1991 | Buchanan et al. |
| 4,994,175 | A | 2/1991 | Hargreaves et al. |
| 5,000,872 | A | 3/1991 | Olah |
| 5,017,281 | A | 5/1991 | Sadeghi et al. |
| 5,036,917 | A | 8/1991 | Jennings, Jr. et al. |
| 5,039,227 | A | 8/1991 | Leung et al. |
| 5,055,212 | A | 10/1991 | Le |
| 5,066,388 | A | 11/1991 | Ross |

5,071,807 A 12/1991 Kennedy et al.
5,073,251 A 12/1991 Daniels
5,083,613 A 1/1992 Gregoli et al.
5,084,079 A 1/1992 Frohnert et al.
5,087,379 A 2/1992 Morton et al.
5,089,052 A 2/1992 Ludwig
5,096,461 A 3/1992 Frankiewicz et al.
5,096,567 A 3/1992 Paspek, Jr. et al.
5,097,903 A 3/1992 Wilensky
5,098,481 A 3/1992 Monlux
5,110,443 A 5/1992 Gregoli et al.
5,122,259 A 6/1992 Nielson
5,124,008 A 6/1992 Rendall et al.
5,143,598 A 9/1992 Graham et al.
5,145,002 A 9/1992 McKay
5,154,831 A 10/1992 Darian et al.
5,156,686 A 10/1992 Van Slyke
5,169,518 A 12/1992 Klimpel et al.
5,173,172 A 12/1992 Adams et al.
5,178,733 A 1/1993 Nielson
5,198,596 A 3/1993 Kaminsky et al.
5,213,625 A 5/1993 Van Slyke
5,215,596 A 6/1993 Van Slyke
5,223,148 A 6/1993 Tipman et al.
5,234,577 A 8/1993 Van Slyke
5,236,577 A 8/1993 Tipman et al.
5,242,580 A 9/1993 Sury
5,252,138 A 10/1993 Guymon
5,264,118 A 11/1993 Cymerman et al.
5,275,507 A 1/1994 Hutter
5,282,984 A 2/1994 Ashrawi
5,283,001 A 2/1994 Gregoli et al.
5,286,386 A 2/1994 Darian et al.
5,290,959 A 3/1994 Rice
5,297,626 A 3/1994 Vinegar et al.
5,316,659 A 5/1994 Brons et al.
5,316,664 A 5/1994 Gregoli et al.
5,320,746 A 6/1994 Green et al.
5,326,456 A 7/1994 Brons et al.
5,340,467 A 8/1994 Gregoli et al.
5,358,917 A 10/1994 Van Veen et al.
5,364,524 A 11/1994 Partridge et al.
5,370,789 A 12/1994 Milne et al.
5,374,350 A 12/1994 Heck et al.
5,392,854 A 2/1995 Vinegar et al.
5,453,133 A 9/1995 Sparks et al.
5,480,566 A 1/1996 Strand
5,534,136 A 7/1996 Rosenbloom
5,564,574 A 10/1996 Kuryluk
5,569,434 A 10/1996 Devanathan et al.
5,626,743 A 5/1997 Humphreys
5,645,714 A 7/1997 Strand et al.
5,690,811 A 11/1997 Davis et al.
5,695,632 A 12/1997 Brons et al.
5,723,042 A 3/1998 Strand et al.
5,744,065 A 4/1998 Galante et al.
5,746,909 A 5/1998 Calta
5,762,780 A 6/1998 Rendall et al.
5,770,049 A 6/1998 Humphreys
5,795,444 A 8/1998 Rendall et al.
5,795,464 A 8/1998 Sankey et al.
5,846,314 A 12/1998 Golley
5,855,243 A 1/1999 Bragg
5,902,554 A 5/1999 Kirkbride
5,911,541 A 6/1999 Johnson
5,919,353 A 7/1999 Itou et al.
5,923,170 A 7/1999 Kuckes
5,927,404 A 7/1999 Bragg
5,957,202 A 9/1999 Huang
5,968,349 A 10/1999 Duyvesteyn et al.
5,968,370 A 10/1999 Trim
5,985,138 A 11/1999 Humphreys
5,998,640 A 12/1999 Haefele et al.
6,004,455 A 12/1999 Rendall
6,007,708 A 12/1999 Allcock et al.
6,007,709 A 12/1999 Duyvesteyn et al.
6,019,499 A 2/2000 Selivanov
6,019,888 A 2/2000 Mishra et al.
6,030,467 A 2/2000 Leser et al.
6,036,844 A 3/2000 Gupta et al.
6,068,054 A 5/2000 Bragg
6,110,359 A 8/2000 Davis et al.
6,119,870 A 9/2000 Maciejewski et al.
6,139,722 A 10/2000 Kirkbride et al.
6,152,356 A 11/2000 Minden
6,153,017 A 11/2000 Ward et al.
6,207,044 B1 3/2001 Brimhall
6,214,213 B1 4/2001 Tipman et al.
6,258,772 B1 7/2001 Yeggy et al.
6,267,716 B1 7/2001 Quintero
6,279,653 B1 8/2001 Wegener et al.
6,306,917 B1 10/2001 Bohn et al.
6,319,395 B1 11/2001 Kirkbride et al.
6,358,404 B1 3/2002 Brown et al.
6,375,976 B1 4/2002 Roden et al.
6,402,934 B1 6/2002 Chheda et al.
6,451,885 B1 9/2002 Dresin et al.
6,464,856 B1 10/2002 Di Tullio
6,494,932 B1 12/2002 Abercrombie
6,527,960 B1 3/2003 Bacon et al.
6,576,145 B2 6/2003 Conaway et al.
6,662,872 B2 12/2003 Gutek et al.
6,673,238 B2 1/2004 Gerhold et al.
6,709,573 B2 3/2004 Smith
6,733,636 B1 5/2004 Heins
6,743,290 B2 6/2004 Dahl et al.
6,746,599 B2 6/2004 Cymerman et al.
6,749,678 B1 6/2004 Reynhout
6,758,963 B1 7/2004 Hantzer et al.
6,821,060 B2 11/2004 McTurk et al.
6,883,607 B2 4/2005 Nenniger et al.
6,904,919 B2 6/2005 Taylor-Smith et al.
6,936,178 B2 8/2005 Peloquin et al.
6,936,543 B2 * 8/2005 Schroeder et al. ..... 438/692
7,008,528 B2 3/2006 Mitchell et al.
7,097,255 B2 8/2006 Drake et al.
RE39,289 E 9/2006 Mitchell et al.
7,141,162 B2 11/2006 Garner et al.
7,150,320 B2 12/2006 Heins
7,168,641 B2 1/2007 Filgueiras
7,186,673 B2 3/2007 Varadaraj et al.
7,189,196 B2 3/2007 Cornay et al.
7,192,092 B2 3/2007 Watson
7,201,804 B2 4/2007 Tunnicliffe et al.
7,256,242 B2 8/2007 Nelson
7,258,788 B2 8/2007 Pollock
7,270,743 B2 9/2007 Freel et al.
7,294,156 B2 11/2007 Chakrabarty et al.
7,338,924 B2 3/2008 Varadaraj
7,341,658 B2 3/2008 Reeves
7,363,973 B2 4/2008 Nenniger et al.
7,399,406 B2 7/2008 Mikula et al.
7,416,671 B2 8/2008 Bozak et al.
7,428,926 B2 9/2008 Heins
7,438,129 B2 10/2008 Heins
7,438,807 B2 10/2008 Garner et al.
7,448,692 B2 11/2008 Drake et al.
7,459,413 B2 12/2008 Shen et al.
7,553,423 B2 6/2009 Buddenberg et al.
7,597,144 B2 10/2009 Minnich et al.
2003/0083206 A1 5/2003 Masikewich et al.
2005/0161372 A1 7/2005 Colic
2005/0197267 A1 9/2005 Zaki et al.
2007/0205141 A1 9/2007 Freeman et al.
2008/0210602 A1 9/2008 Duyvesteyn et al.

FOREIGN PATENT DOCUMENTS

CA 448231 5/1948
CA 488928 12/1952
CA 493081 5/1953
CA 675930 12/1963
CA 778347 2/1968
CA 719690 8/1968
CA 914092 11/1972
CA 914094 11/1972
CA 915602 11/1972
CA 915603 11/1972
CA 915604 11/1972

| | | |
|---|---|---|
| CA | 915608 | 11/1972 |
| CA | 917565 | 12/1972 |
| CA | 917585 | 12/1972 |
| CA | 949482 | 6/1974 |
| CA | 975696 | 10/1975 |
| CA | 975697 | 10/1975 |
| CA | 975698 | 10/1975 |
| CA | 975699 | 10/1975 |
| WO | 9510369 | 4/1995 |

OTHER PUBLICATIONS

Supplementary Partial European Search Report for Application No. EP 07 87 1125, dated Dec. 2, 2009 (8 pages).
Online Technical Bulletin XP-002555082 of BASF Corporation, entitled MAPHOS 66 H Aromatic Phosphate Ester, 2002 (1 page).
Web pages from www.nanochemtechnologies.net, "ChemExtract(™) History of Development", dated Jul. 7, 2006 (2 pages).
Web pages from www.nanochemtechnologies.net, "ChemExtract(™) Material Safety Data Sheet", dated Jul. 7, 2006 (2 pages).
International Preliminary Report on Patentability from related PCT Application No. PCT/US2007/080563; Apr. 16, 2009 (2 pages).
International Search Report from related PCT Application No. PCT/US20071080563; Jul. 25, 2008 (2 pages).
Written Opinion from related PCT Application No. PCT/US2007/080563; Jul. 25, 2008 (5 pages).
Office Action from related U.S. Appl. No. 12/765,969; Jun. 7, 2010.
Office Action from related U.S. Appl. No. 12/765,982; Jun. 7, 2010.
Office Action from related U.S. Appl. No. 12/605,621; Jun. 25, 2010 (8 pages).
Notice of Allowance from related U.S. Appl. No. 11/868,031; May 24, 2010.
Notice of Allowance from related U.S. Appl. No. 12/556,878; Jun. 3, 2010 (14 pages).
Notice of Allowance from related U.S. Appl. No. 12/765,969; Aug. 25, 2010 (14 pages).
Notice of Allowance from related U.S. Appl. No. 12/765,982 (along with Interview Summary); Aug. 24, 2010.
Notice of Allowance from related U.S. Appl. No. 12/761,845; Jun. 22, 2010 (6 pages).
Notice of Allowance from related U.S. Appl. No. 12/650,621; Nov. 26, 2010 (13 pages).
U.S. Office Action—corresponding U.S. Appl. No. 12/952,963, filed Nov. 23, 2010; Dated May 9, 2011 (6 pages).
Notice of Allowance—corresponding U.S. Appl. No. 12/650,621, filed Dec. 31, 2009; Dated Mar. 29, 2011 (5 pages).

* cited by examiner

SEPARATING COMPOSITIONS

RELATED U.S. APPLICATION DATA

This application is a continuation of U.S. Non Provisional application Ser. No. 12/765,962 filed on Apr. 23, 2010, issued as U.S. Pat. No. 7,867,385 on Jan. 11, 2011, which is a continuation of U.S. Non Provisional application Ser. No. 11/868,031 filed on Oct. 5, 2007, issued as U.S. Pat. No. 7,749,379 on Jul. 6, 2010, which claims the benefit of priority from U.S. Provisional Application No. 60/828,501 filed on Oct. 6, 2006. The entire disclosures of the earlier applications are hereby incorporated by reference.

BACKGROUND

Oil sands, also known as "tar sands" and "bituminous sands," are a mixture of bitumen (tar), sand, and water. Bitumen is a heavy, viscous crude oil, having relatively high sulfur content. When properly separated from the oil sands, bitumen may be processed to synthetic crude oil suitable for use as a feedstock for the production of liquid motor fuels, heating oil, and petrochemicals. Oil sand fields exist throughout most of the world. Particularly significant deposits exist in Canada, including the Athabasca oil sands in Alberta, the United States, including the Utah oil sands, South America, including the Orinoco oil sands in Venezuela, and Africa, including the Nigerian oil sands http://en.wikipedia.org/wiki/Orinoco-_Belt. A majority of all of the known oil in the world is contained in oil sands.

Bitumen is very difficult to separate from oil sands in an efficient and environmentally acceptable manner. Current efforts to separate bitumen from oil sands typically yield only about 85-92% of the available bitumen. Moreover, current efforts to separate bitumen from oil sands include the creation of emulsions, or "froth," during processing, requiring the use of environmentally harmful organic solvents such as naphtha to "crack" the emulsions and allow for further processing. In addition, the bitumen that remains in the sand (and other particulate matter, such as clay) component of the oil sands contributes to the creation of a heavy sludge, often referred to as "tailings." Current practice for the disposal of the tailings, which are comprised of unrecovered bitumen, sand (and other particulate matter), and water is to pump the tailings into huge tailings ponds, where the sand and other particulate matter slowly settle and stratify over the course of several years.

SUMMARY

The present exemplary embodiments describe compositions and methods for separating bitumen from oil sands in an efficient and environmentally acceptable manner, and for recovering residual bitumen from existing tailings ponds.

According to one aspect of the present embodiments, a composition is provided, comprising a separating composition comprising a hydrotropic agent and a dispersant having flocculating characteristics, wherein the separating composition has a pH of greater than 7.5.

According to another aspect of the present embodiments, a separating composition is provided, comprising from about 0.1% to about 4.0% by weight of a hydrotropic agent; and from about 0.25% to about 4.5% by weight of a dispersant having flocculating characteristics.

According to another aspect of the present embodiments, a separating composition for separating bitumen from oil sands or tailings is provided, comprising from about 0.1% to about 4.0% by weight of an aromatic phosphate ester having the formula:

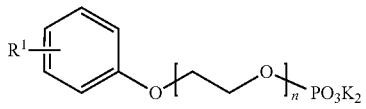

wherein $R^1$ is a $C_1$-$C_5$ linear or branched alkyl group and n=1 to 8; from about 0.001% to about 4.5% by weight of sodium acid pyrophosphate; from about 0.001% to about 4.5% by weight of tetrapotassium pyrophosphate; from about 2% to about 9.5% by weight of sodium hydroxide; and from about 1.7% to about 8.6% by weight of phosphoric acid, wherein the separating composition has a pH of from about 7.0 to about 8.5.

DETAILED DESCRIPTION

As used herein, the term "about" means "approximately," and, in any event, may indicate as much as a 10% deviation from the number being modified.

As used herein, "essentially free" means an amount less than about 0.1%.

In one embodiment, a composition is provided, comprising a separating composition comprising a hydrotropic agent, and a dispersant having flocculating characteristics, wherein the separating composition has a pH of greater than 7.5.

In one embodiment, the composition further comprises a wetting agent. Suitable wetting agents may include, for example, one or more of DYNOL™ 607 Surfactant (Air Products and Chemicals, Inc.), SURFYNOL® 420 (Air Products and Chemicals, Inc.), SURFYNOL® 440 (Air Products and Chemicals, Inc.), SURFYNOL® 465 (Air Products and Chemicals, Inc.), SURFYNOL® 485 (Air Products and Chemicals, Inc.), DYNOL™ 604 Surfactant (Air Products and Chemicals, Inc.), TOMADOL® 91-2.5 (Tomah Products, Inc.), TOMADOL® 91-6 (Tomah Products, Inc.), TOMADOL® 91-8 (Tomah Products, Inc.), TOMADOL® 1-3 (Tomah Products, Inc.), TOMADOL® 1-5 (Tomah Products, Inc.), TOMADOL® 1-7 (Tomah Products, Inc.), TOMADOL® 1-73B (Tomah Products, Inc.), TOMADOL® 1-9 (Tomah Products, Inc.), TOMADOL® 23-1 (Tomah Products, Inc.), TOMADOL® 23-3 (Tomah Products, Inc.), TOMADOL® 23-5 (Tomah Products, Inc.), TOMADOL® 23-6.5 (Tomah Products, Inc.), TOMADOL® 25-3 (Tomah Products, Inc.), TOMADOL® 25-7 (Tomah Products, Inc.), TOMADOL® 25-9 (Tomah Products, Inc.), TOMADOL® 25-12 (Tomah Products, Inc.), TOMADOL® 45-7 (Tomah Products, Inc.), TOMADOL® 45-13 (Tomah Products, Inc.), TRITON™ X-207 Surfactant (Dow Chemical Company), TRITON™ CA Surfactant (Dow Chemical Company), NOVEC™ Fluorosurfactant FC-4434 (3M Company), POLYFOX™ AT-1118B (Omnova Solutions, Inc.), ZONYL® 210 (Dupont), ZONYL® 225 (Dupont), ZONYL® 321 (Dupont), ZONYL® 8740 (Dupont), ZONYL® 8834L (Dupont), ZONYL® 8857A (Dupont), ZONYL® 8952 (Dupont), ZONYL® 9027 (Dupont), ZONYL® 9338 (Dupont), ZONYL® 9360 (Dupont), ZONYL® 9361 (Dupont), ZONYL® 9582 (Dupont), ZONYL® 9671 (Dupont), ZONYL® FS-300 (Dupont), ZONYL® FS-500 (Dupont), ZONYL® FS-610 (Dupont), ZONYL® 1O33D (Dupont), ZONYL® FSE (DuPont), ZONYL® FSK (DuPont), ZONYL® FSH (DuPont), ZONYL® FSJ (DuPont), ZONYL® FSA (DuPont), ZONYL® FSN-100 (DuPont), LUTENSOL® OP 30-70% (BASF), LUTENSOL® A 12 N (BASF), LUTENSOL® A 3 N (BASF), LUTENSOL® A 65 N (BASF), LUTENSOL® A 9 N (BASF), LUTENSOL® AO 3 (BASF), LUTENSOL® AO 4 (BASF), LUTENSOL® AO 8 (BASF), LUTENSOL® AT 25 (BASF), LUTENSOL® AT 55 PRILL SURFACTANT (BASF), LUTENSOL® CF 10 90 SURFACTANT (BASF), LUTENSOL® DNP 10 (BASF), LUTENSOL® NP 4 (BASF), LUTENSOL® NP 10 (BASF), LUTENSOL® NP-100 PASTILLE (BASF), LUTENSOL® NP-6 (BASF), LUTENSOL® NP-70-70% (BASF), LUTENSOL® NP-50 (BASF), LUTENSOL® NP 9 (BASF), LUTENSOL® ON 40 SURFACTANT (BASF), LUTENSOL® ON 60 (BASF), LUTENSOL® OP-10 (BASF), LUTENSOL® TDA 10 SURFACTANT (BASF), LUTENSOL® TDA 3 SURFACTANT (BASF), LUTENSOL® TDA 6 SURFACTANT (BASF), LUTENSOL® TDA 9 SURFACTANT (BASF), LUTENSOL® XL 69 (BASF), LUTENSOL® XL 100 (BASF), LUTENSOL® XL 140 (BASF), LUTENSOL® XL 40 (BASF), LUTENSOL® XL 50 (BASF), LUTENSOL® XL 60 (BASF), LUTENSOL® XL 70 (BASF), LUTENSOL® XL 79 (BASF), LUTENSOL® XL 80 (BASF), LUTENSOL® XL 89 (BASF), LUTENSOL® XL 90 (BASF), LUTENSOL® XL 99 (BASF), LUTENSOL® XP 100 (BASF), LUTENSOL® XP 140 (BASF), LUTENSOL® XP 30 (BASF), LUTENSOL® XP 40 (BASF), LUTENSOL® XP 50 (BASF), LUTENSOL® XP 60 (BASF), LUTENSOL® XP 69 (BASF), LUTENSOL® XP 70 (BASF), LUTENSOL® XP 79 (BASF), LUTENSOL® XP 80 (BASF), LUTENSOL® XP 89 (BASF), LUTENSOL® XP 90 (BASF), LUTENSOL® XP 99 (BASF), MACOL® 16 SURFACTANT (BASF), MACOL® CSA 20 POLYETHER (BASF), MACOL® LA 12 SURFACTANT (BASF), MACOL® LA 4 SURFACTANT (BASF), MACOL® LF 110 SURFACTANT (BASF), MACOL® LF 125A SURFACTANT (BASF), MAZON® 1651 SURFACTANT (BASF), MAZOX® LDA Lauramine OXIDE (BASF), PLURAFAC® AO8A Surfactant (BASF), PLURAFAC® B-26 Surfactant (BASF), PLURAFAC® B25-5 Surfactant (BASF), PLURAFAC® D25 Surfactant (BASF), PLURAFAC® LF 1200 Surfactant (BASF), PLURAFAC® LF 2210 Surfactant (BASF), PLURAFAC® LF 4030 Surfactant (BASF), PLURAFAC® LF 7000 Surfactant (BASF), PLURAFAC® RA-20 Surfactant (BASF), PLURAFAC® RA 30 Surfactant (BASF), PLURAFAC® RA 40 Surfactant (BASF), PLURAFAC® RCS 43 Surfactant (BASF), PLURAFAC® RCS 48 Surfactant (BASF), PLURAFAC® S205LF Surfactant (BASF), PLURAFAC® S305LF Surfactant (BASF), PLURAFAC® S505LF Surfactant (BASF), PLURAFAC® SL 62 Surfactant (BASF), PLURAFAC® SL 92 Surfactant (BASF), PLURAFAC® SL-22 Surfactant (BASF), PLURAFAC® SL-42 Surfactant (BASF), PLURAFAC® SLF 37 Surfactant (BASF), PLURAFAC® SLF-18 Surfactant (BASF), PLURAFAC® SLF-18B-45 Surfactant (BASF), PLURAFAC® L1220 Surfactant (BASF), PLURONIC® 10R5 SURFACTANT (BASF), PLURONIC® 17R2 (BASF), PLURONIC® 17R4 (BASF), PLURONIC® 25R2 (BASF), PLURONIC® 25R4 (BASF), PLURONIC® 31R1 (BASF), PLURONIC® F108 CAST SOLID SURFACTANT (BASF), PLURONIC® F108 NF CAST SOLID SURFACTANT (BASF), PLURONIC® F108 NF PRILL SURFACTANT (BASF), PLURONIC® F108 PASTILLE SURFACTANT (BASF), PLURONIC® F127 CAST SOLID SURFACTANT (BASF), PLURONIC® F127 NF PRILL Surfactant (BASF), PLURONIC® F127NF 500BHT CAST SOLID SURFACTANT (BASF), PLURONIC® F38 CAST SOLID SURFACTANT (BASF), PLURONIC® PASTILLE (BASF), PLURONIC® F68 LF PASTILLE SURFACTANT (BASF), PLURONIC® F68 CAST SOLID SURFACTANT (BASF), PLURONIC® F77 CAST SOLID SURFACTANT (BASF), PLURONIC® F-77 MICRO PASTILLE SURFACTANT (BASF), PLURONIC® F87 CAST SOLID SURFACTANT (BASF), PLURONIC® F88 CAST SOLID SURFACTANT (BASF), PLURONIC® F98 CAST SOLID SURFACTANT (BASF), PLURONIC® L10 SURFACTANT (BASF), PLURONIC® L101 SURFACTANT (BASF), PLURONIC® L121 SURFACTANT (BASF), PLURONIC® L31 SURFACTANT (BASF), PLURONIC® L92 SURFACTANT (BASF), PLURONIC® N-3 SURFACTANT (BASF), PLURONIC® P103 SURFACTANT (BASF), PLURONIC® P105 SURFACTANT (BASF), PLURONIC® P123 SURFACTANT (BASF), PLURONIC® P65 SURFACTANT (BASF), PLURONIC® P84 SURFACTANT (BASF), PLURONIC® P85 SURFACTANT (BASF), TETRONIC® 1107 micro-PASTILLE SURFACTANT (BASF), TETRONIC® 1107 SURFACTANT (BASF), TETRONIC® 1301 SURFACTANT (BASF), TETRONIC® 1304 SURFACTANT (BASF), TETRONIC® 1307 Surfactant (BASF), TETRONIC® 1307 SURFACTANT PASTILLE (BASF), TETRONIC® 150R1 SURFACTANT (BASF), TETRONIC® 304 SURFACTANT (BASF), TETRONIC® 701 SURFACTANT (BASF), TETRONIC® 901 SURFACTANT (BASF), TETRONIC® 904 SURFACTANT (BASF), TETRONIC® 908 CAST SOLID SURFACTANT (BASF), and TETRONIC® 908 PASTILLE SURFACTANT (BASF), and mixtures thereof. In one specific embodiment, the wetting agent may include one or more ethoxylated acetylenic alcohols, such as, for example, 2,5,8,11-tetramethyl-6-dodecyn-5,8-diol ethoxylate.

In another embodiment, the composition excludes a wetting agent altogether. In one embodiment, the exclusion of a wetting agent allows for an increased surface tension in the composition. Lower surface tensions may encourage the formation of emulsions that interfere with the flocculation of solids out of the composition when applied to oil sands. Lower surface tension further may interfere with the transfer of mechanical energy within the system.

Suitable hydrotropic agents may include, for example, one or more of TRITON® H-66 (Dow Chemical Company), TRITON® H-55 (Dow Chemical Company), TRITON® QS-44 (Dow Chemical Company), TRITON® XQS-20 (Dow Chemical Company), TRITON® X-15 (Union Carbide Corporation), TRITON® X-35 (Union Carbide Corporation), TRITON® X-45 (Union Carbide Corporation), TRITON® X-114 (Union Carbide Corporation), TRITON® X-100 (Union Carbide Corporation), TRITON® X-165 (70%) active (Union Carbide Corporation), TRITON® X-305 (70%) active (Union Carbide Corporation), TRITON® X-405 (70%) active (Union Carbide Corporation), TRITON® BG Nonionic Surfactant (Union Carbide Corporation), TERGITOL® MinFoam 1X (Dow Chemical Company), TERGITOL® L-61 (Dow Chemical Company), TERGITOL® L-64 (Dow Chemical Company), TERGITOL® L-81 (Dow Chemical Company), TERGITOL® L-101 (Dow Chemical Company), TERGITOL® NP-4 (Dow Chemical Company), TERGITOL® NP-6 (Dow Chemical Company), TERGITOL® NP-7 (Dow Chemical Company), TERGITOL® NP-8 (Dow Chemical Company), TERGITOL® NP-9 (Dow Chemical Company), TERGITOL® NP-11 (Dow Chemical Company), TERGITOL® NP-12 (Dow Chemical Company), TERGITOL® NP-13 (Dow Chemical Company), TERGITOL® NP-15 (Dow Chemical Company), TERGITOL® NP-30 (Dow Chemical Company), TERGITOL® NP-40 (Dow Chemical Company), SURFYNOL® 420 (Air Products and Chemicals, Inc.), SURFYNOL® 440 (Air Products and Chemicals, Inc.), SURFYNOL® 465 (Air Products and Chemicals, Inc.), SURFYNOL® 485 (Air Products and Chemicals, Inc.), MAPHOS® 58 ESTER (BASF), MAPHOS® 60 A Surfactant (BASF), MAPHOS® 66 H ESTER (BASF), MAPHOS® 8135 ESTER (BASF), MAPHOS® M-60 ESTER (BASF), 6660 K Hydrotroping Phosphate Ester Salt (Burlington Chemical), BURCOFAC 7580 Aromatic Phosphate Ester (Burlington Chemical), and BURCOFAC 9125 (Burlington Chemical), and mixtures thereof.

In one specific embodiment, the hydrotropic agent may be one or more aromatic phosphate esters, such as, for example, an aromatic phosphate ester having the formula:

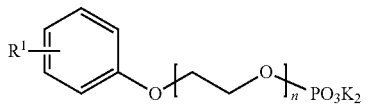

wherein $R^1$ is a $C_1$-$C_5$ linear or branched alkyl group and n=1 to 8.

Suitable dispersants having flocculating characteristics may include, for example, one or more of sodium acid pyrophosphate, tetrapotassium pyrophosphate, monosodium phosphate ($H_6NaO_6P$), monoammonium phosphate ($(NH_4)PO_4$), sodium acid phosphate, trisodium phosphate, sodium tripolyphosphate, sodium trimetaphosphate, sodium laurel phosphate, sodium phosphate, pentapotassium triphosphate, potassium triphosphate, tetraborate potassium tripolyphosphate, potassium phosphate-monobasic, potassium phosphate-dibasic, monopotassium phosphate, and tripotassium phosphate, and mixtures thereof. In one specific embodiment, the dispersant having flocculating characteristics may include one or more pyrophosphate salts, including, for example, one or more of sodium acid pyrophosphate and tetrapotassium pyrophosphate.

In one embodiment, the hydrotropic agent may be present in the amount of from about 0.1% to about 4.0% by weight of the separating composition. The dispersant having flocculating characteristics may be present in the amount of from about 0.25% to about 4.5% by weight of the separating composition.

In one embodiment, the separating composition may further comprise a strong base, such as, for example, hydroxides of alkali metals and alkaline earth metals, such as, for example, NaOH, KOH, $Ba(OH)_2$, CsOH, SrOH, $Ca(OH)_2$, LiOH, RbOH, NaH, LDA, and $NaNH_2$. As used herein, a "strong base" is a chemical compound having a pH of greater than about 13. The strong base may be present in the amount of from about 2% to about 9.5% by weight of the separating composition.

In one embodiment, the separating composition may further comprise a heavy acid, such as, for example, phosphoric acid, nitric acid, sulfuric acid, hydronic acid, hydrobromic acid, perchloric acid, fluoromatic acid, magic acid ($FSO_3HSbF_5$), carborane super acid [$H(CHB_{11}Cl_{11})$], triflic acid, ethanoic acid, and acetylsalicylic acid. As used herein, a "heavy" acid is an acid having a specific gravity greater than about 1.5. The heavy acid may be present in the amount of from about 1.7% to about 8.6% by weight of the separating composition.

In one embodiment, the pH of the separating composition may be greater than 7.5. The pH of the separating composition may also be from about 7.0 to about 8.5. The pH of the separating composition may also be from about 7.6 to about 7.8.

In another embodiment, the composition may be essentially free of organic solvent. As used herein, the term "organic solvent" refers to solvents that are organic compounds and contain carbon atoms such as, for example, naphtha, benzene, and other hydrocarbon solvents.

In addition to the separating composition, the composition may also comprise hydrocarbon containing materials, such as oil sands, tailings, sludge, and the like. The ratio of the separating composition to the hydrocarbon containing materials may be from about 1:100 to about 100:1, from about 1:10 to about 10:1, from about 2:3 to about 3:2, or about 1:1.

In yet another embodiment, a separating composition is provided, comprising from about 0.1% to about 4.0% by weight of a hydrotropic agent; and from about 0.25% to about 4.5% by weight of a dispersant having flocculating characteristics. The separating composition may have a pH of greater than 7.5; from about 7.0 to about 8.5; or from about 7.6 to about 7.8. The hydrotropic agent may be, for example, MAPHOS® 66H aromatic phosphate ester. The dispersant having flocculating characteristics may be, for example, one or more of sodium acid pyrophosphate and tetrapotassium pyrophosphate.

The separating composition may further comprise a strong base, which may be, for example, sodium hydroxide. The strong base may be present in the amount of from about 2% to about 9.5% by weight of the separating composition. The separating composition may further comprise a heavy acid, which may be, for example, phosphoric acid. The heavy acid may be present in the amount of from about 1.7% to about 8.6% by weight of the separating composition. The separating composition may also be essentially free or completely free of organic solvent.

In one embodiment, a separating composition for separating bitumen from oil sands or tailings is provided, comprising from about 0.1% to about 4.0% by weight of an aromatic phosphate ester having the formula:

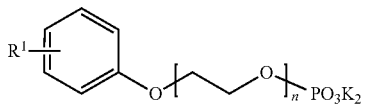

wherein $R^1$ is a $C_1$-$C_5$ linear or branched alkyl group and n=1 to 8; from about 0% to about 4.5% by weight of sodium acid pyrophosphate; from about 0% to about 4.5% by weight of tetrapotassium pyrophosphate; from about 2.0% to about 9.5% by weight of sodium hydroxide; and from about 1.7% to about 8.6% by weight of phosphoric acid. The separating composition may have a pH of from about 7.0 to about 8.5. The separating composition may also be essentially free of organic solvent.

In one embodiment, a method for separating bitumen from oil sands is provided, comprising contacting a separating composition comprising a hydrotropic agent and a dispersant having flocculating characteristics with oil sands comprising bitumen and sand; heating the separating composition and the oil sands; agitating the separating composition and the oil sands; and recovering the bitumen and sand as separate products. The pH of the separating composition may be greater than 7.5; from about 7.0 to about 8.5; or from about 7.6 to about 7.8.

In one embodiment, the separating composition used in the exemplary method may be comprised of from about 0.1% to about 4.0% by weight of a hydrotropic agent; and from about 0.25% to about 4.5% by weight of a dispersant having flocculating characteristics.

In another embodiment, the separating composition used in the exemplary method may be comprised of from about 0.1% to about 4.0% by weight of an aromatic phosphate ester having the formula:

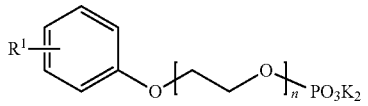

wherein $R^1$ is a $C_1$-$C_5$ linear or branched alkyl group and n=1 to 8; from about 0% to about 4.5% by weight of sodium acid pyrophosphate; from about 0% to about 4.5% by weight of tetrapotassium pyrophosphate; from about 2% to about 9.5% by weight of sodium hydroxide; and from about 1.7% to about 8.6% by weight of phosphoric acid.

With respect to the process conditions under which the exemplary method may be carried out, the separating composition and the oil sands may be heated to greater than 25° C.; from about 32° C. to about 72° C.; or from about 54° C. to about 60° C. Any source of heat within the ambit of those skilled in the art may be used. Similarly, any device capable of providing sufficient agitation may be used to agitate the separating composition and the oil sands, including, for example, a high shear mixer, high speed attritor, high speed dispersers, fluidized beds, and the like, or any other device capable of providing sufficient agitation within the ambit of those skilled in the art.

In one embodiment, the ratio of the separating composition to the oil sands may be from about 2:3 to about 3:2. In another embodiment, the ratio of the separating composition to the oil sands may be about 1:1.

The recovered bitumen may be essentially emulsion-free. The exemplary method may be performed without the addition of organic solvent.

In some circumstances, it may prove desirable to subject the separated, recovered bitumen to a second or subsequent aliquot of separating composition. In such a case, the exemplary method further comprises contacting the separated, recovered bitumen with a second or subsequent aliquot of fresh separating composition; heating the fresh separating composition and the bitumen; agitating the fresh separating composition and the recovered bitumen; and recovering the resulting bitumen. Such a "rinse" cycle may be repeated until the bitumen is essentially free of any sand or other particulate matter.

In another embodiment, the separating composition may be recyclable. Thus, the exemplary method further comprises recovering the separating composition; contacting the recovered separating composition with a second or subsequent aliquot of oil sands comprising bitumen and sand; heating the recovered separating composition and the second or subsequent aliquot of oil sands; agitating the recovered separating composition and the second or subsequent aliquot of oil sands; and recovering the bitumen and sand as separate products.

In another embodiment, a method is disclosed for processing existing tailings, both to salvage remaining bitumen and to allow for redeposit of the essentially bitumen-free sand. The method may comprise contacting a separating composition comprising a hydrotropic agent and a dispersant having flocculating characteristics with tailings comprising bitumen and sand; heating the separating composition and the tailings; agitating the separating composition and the tailings; and recovering the bitumen and sand as separate products. The pH of the separating composition may be greater than 7.5; from about 7.0 to about 8.5; or from about 7.6 to about 7.8.

In one embodiment, the separating composition used in the exemplary method for processing existing tailings may be comprised of from about 0.1% to about 4.0% by weight of a hydrotropic agent; and from about 0.25% to about 4.5% by weight of a dispersant having flocculating characteristics.

In another embodiment, the separating composition used in the exemplary method for processing existing tailings may be comprised of from about 0.1% to about 4.0% by weight of an aromatic phosphate ester having the formula:

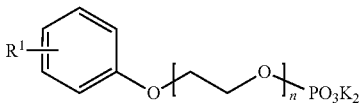

wherein $R^1$ is a $C_1$-$C_5$ linear or branched alkyl group and n=1 to 8; from about 0% to about 4.5% by weight of sodium acid pyrophosphate; from about 0% to about 4.5% by weight of tetrapotassium pyrophosphate; from about 2% to about 9.5% by weight of sodium hydroxide; and from about 1.7% to about 8.6% by weight of phosphoric acid.

With respect to the process conditions under which the exemplary method for processing existing tailings may be carried out, the separating composition and the tailings may be heated to greater than 25° C.; from about 32° C. to about 72° C.; or from about 54° C. to about 60° C. Any source of heat within the ambit of those skilled in the art may be used. Similarly, any device capable of providing sufficient agitation may be used to agitate the separating composition and the tailings, including, for example, a high shear mixer, high speed attritor, high speed dispersers, fluidized beds, and the like, or any other device capable of providing sufficient agitation within the ambit of those skilled in the art.

In one embodiment, the ratio of the separating composition to the tailings may be from about 2:3 to about 3:2. In another embodiment, ratio of the separating composition to the tailings may be about 1:1.

The recovered bitumen may be essentially emulsion-free. The exemplary method may be performed without the addition of organic solvent.

In some circumstances, it may prove desirable to subject the separated, recovered bitumen from the tailings to a second or subsequent aliquot of separating composition. In such a case, the exemplary method further comprises contacting the separated, recovered bitumen with a second or subsequent aliquot of fresh separating composition; heating the fresh separating composition and the bitumen; agitating the fresh separating composition and the recovered bitumen; and recovering the resulting bitumen. Such a "rinse" cycle may be repeated until the bitumen is essentially free of any sand or other particulate matter.

In another embodiment, the separating composition may be recyclable. Thus, the exemplary method for processing existing tailings would further comprise recovering the separating composition; contacting the recovered separating composition with a second or subsequent aliquot of tailings comprising bitumen and sand; heating the recovered separating composition and the second or subsequent aliquot of tailings;

agitating the recovered separating composition and the second or subsequent aliquot of tailings; and recovering the bitumen and sand as separate products.

The present embodiments have been described mainly in the context of lab-scale results. However, it should be appreciated that the results described herein are meant to embody the entire process by which oil sands are obtained, the extraction of bitumen from the oil sands, and the further processing of the extracted bitumen. By way of example, mining shovels dig oil sand ore and load it into trucks or other transportation means. The trucks take the oil sands to crushers where the oil sands are broken down in size. The broken down oil sands are added to a mixing tank and contacted with the separating composition as described herein. The separated bitumen is augered and pumped to storage, and then further refined to produce synthetic crude oil suitable for use as a feedstock for the production of liquid motor fuels, heating oil, and petrochemicals.

The following examples are provided to illustrate various embodiments and shall not be considered as limiting in scope.

EXAMPLE 1

Separation of Bitumen from Athabasca Oil Sands 300 g of the following separating composition was prepared and placed in a 1 L beaker:

| Composition 1 | |
|---|---|
| 270.84 g | $H_2O$ |
| 10.8 g | Phosphoric acid 75% |
| 1.20 g | Sodium acid pyrophosphate |
| 13.44 g | Caustic soda 50% |
| 3.12 g | Tetrapotassium pyrophosphate 60% |
| 0.60 g | MAPHOS ® 66 H ESTER |

The beaker containing Composition 1 was charged with 300 g of Athabasca oil sands. The resultant slurry was heated to between 54° C. and 60° C. A high shear lab mixer was lowered into the beaker and the slurry was stirred at 3500 rpm for 3 minutes. The mixer was removed from the beaker. Over the course of the next 5-30 minutes, complete phase separation occurred within the beaker. Four separate, distinct phases were observed. The top, first layer contained bitumen. The second layer contained the separating composition. The third layer contained clay. The bottom, fourth layer contained sand and other particulate matter.

The beaker contents were allowed to cool, at which time the bitumen was removed from the beaker by use of a spoon (although other physical separation means such as decanting or the use of a syringe or other suction device could also be utilized). The bitumen was determined to be greater than 99% free of contaminants, including sand and clay. Approximately 45 g of bitumen was recovered, representing greater than 99% of all of the available bitumen in the sample of oil sands.

The sand was also recovered and determined to be greater than 99% free of bitumen. The sand was placed in a drying oven at 72° C. for 8 hours and, after cooling to room temperature, was able to be sifted through a 20-25 mesh sieve.

To further quantify the amount of bitumen remaining in the sand, 255 g of the dried sand was placed in a beaker. 255 g of toluene was added to the sand. The resultant slurry was agitated, then allowed to settle. The toluene was then decanted from the sand. The decanted toluene was visually inspected and found to be clear. The sand was dried again at 72° C. for 8 hours to evaporate any remaining toluene. Thereafter, the sand was weighed, and 255 g of sand remained.

EXAMPLE 2

Separation of Bitumen from Utah Oil Sands 300 g of the following separating composition was prepared and placed in a 1 L beaker:

| Composition 2 | |
|---|---|
| 263.55 g | $H_2O$ |
| 13.55 g | Phosphoric acid 75% |
| 1.50 g | Sodium acid pyrophosphate |
| 16.80 g | Caustic soda 50% |
| 3.90 g | Tetrapotassium pyrophosphate 60% |
| 0.75 g | MAPHOS ® 66 H ESTER |

The beaker containing Composition 2 was charged with 300 g of Utah oil sands. The resultant slurry was heated to between 54° C. and 60° C. A high shear lab mixer was lowered into the beaker and the slurry was stirred at 3500 rpm for 3 minutes. The mixer was removed from the beaker. Over the course of the next 5-30 minutes, complete phase separation occurred within the beaker. Four separate, distinct phases were observed. The top, first layer contained bitumen. The second layer contained the separating composition. The third layer contained clay. The bottom, fourth layer contained sand and other particulate matter.

The beaker contents were allowed to cool, at which time the bitumen was removed from the beaker by use of a spoon (although other physical separation means such as decanting or the use of a syringe or other suction device could also be utilized). The bitumen was determined to be greater than 99% free of contaminants, including sand and clay. Approximately 40 g of bitumen was recovered, representing greater than 99% of the available bitumen in the sample of oil sands.

The sand was also recovered and determined to be greater than 99% free of bitumen. The sand was placed in a drying oven at 72° C. for 8 hours and, after cooling to room temperature, was able to be sifted through a 20-25 mesh sieve.

To further quantify the amount of bitumen remaining in the sand, 266 g of the dried sand was placed in a beaker. 266 g of toluene was added to the sand. The resultant slurry was agitated, then allowed to settle. The toluene was then decanted from the sand. The decanted toluene was visually inspected and found to be clear. The sand was dried again at 72° C. for 8 hours to evaporate any remaining toluene. Thereafter, the sand was weighed, and 266 g of sand remained.

EXAMPLE 3

Preparation of Separating Composition Using River Water

River water from the Athabasca River located in northern Alberta province, Canada ("River Water") was provided from Canada. 800 g of separating composition was made using the River Water and according to a standard formula (provided below in Table 1). 210 g of the separating composition was mixed with 90 g of Canadian Oil Sands (from the Athabasca region in northern Alberta province, Canada). Prior to mixing with the Canadian Oil Sands, the pH of the separating composition was adjusted to 7.76 using phosphoric acid.

The mixture of the separating composition and Canadian Oil Sands was placed into a Mason jar. The samples were heated to 140° F. (about 61° C.) using a microwave oven. After heating, in order to disperse the mixture, a 10,000 rpm high speed disperser with 1" blade was utilized. A Premier Mill, Series 2000, Model 2000, 110 V, 1 horsepower, 12 amp bench top disperser was utilized as the high speed disperser. The disperser was utilized for approximately 3 minutes. Thereafter, as the sample sat in place the constituents settled and distinct layers began to form. Within a half hour three distinct layers had formed with bitumen in the top layer, the used separating composition in the second layer, and solids (e.g., sand and clay) in the third layer. The result achieved in terms of the separating into three distinct layers appeared to be almost exactly as a control (made using Deionized Water) indicating that the River Water would be acceptable for use in preparing the separating composition with no need for pre-treatment.

After the Mason Jar contents had cooled and the three distinct layers had formed (approximately 1 hour), the bitumen was removed from the Mason Jar by use of a spoon (although other physical separation means such as decanting or the use of a syringe or other suction device could also be utilized). The bitumen was determined to be greater than 99% free of contaminants, including sand and clay. Approximately 9 g of bitumen was recovered, representing greater than 99% of all of the available bitumen in the sample of Canadian Oil Sands.

| Amount (grams) | Ingredient |
|---|---|
| 184 | Water |
| 9.45 | Phosphoric acid (75%) |
| 1.05 | Sodium acid pyrophosphate |
| 11.7 | Caustic soda (50%) |
| 2.73 | Tetrapotassium pyrophosphate (60%) |
| 0.52 | MAPHOS ® 66 H ESTER |

EXAMPLE 4

Preparation of Separating Composition with Process Water

Process water (or recirculation water) utilized in the processing of Athabasca oil sands was provided from Canada ("Process Water"). The Process Water was brown-colored and appeared to contain clay suspended in an emulsion. 800 g of separating composition was made using the Process Water according to the standard formula provided above in Table 1. The separating composition was allowed to sit for a hour during which time all or substantially all of the clay in the Process Water flocculated out and settled. After flocculation and settling had occurred, the separating solution was decanted away from the flocculated clay. Thereafter, the separating composition was adjusted to a pH of 7.76 (using phosphoric acid) and then 210 g of the separating composition was mixed with 90 g of Canadian Oil Sands (from the Athabasca region in northern Alberta province, Canada).

The mixture of the separating composition and the Canadian Oil Sands was placed into a Mason jar. The samples were heated to 140° F. (about 61° C.) using a microwave oven. After heating, in order to disperse the mixture, a 10,000 rpm high speed disperser with 1" blade was utilized. A Premier Mill, Series 2000, Model 2000, 110 V, 1 horsepower, 12 amp bench top disperser was utilized as the high speed disperser. The disperser was utilized for approximately 3 minutes. Thereafter, as the sample sat in place the constituents settled and distinct layers began to form. Within a half hour three distinct layers had formed with bitumen in the top layer, the used separating composition in the second layer, and solids (e.g., sand and clay) in the third layer. The reaction was almost exactly as the control indicating that the Process Water would be acceptable for use in preparing the separating composition with no need for pre-treatment.

After the Mason Jar contents had cooled and the three distinct layers had formed (approximately 1 hour), the bitumen was removed from the Mason Jar by use of a spoon (although other physical separation means such as decanting or the use of a syringe or other suction device could also be utilized). The bitumen was determined to be greater than 99% free of contaminants, including sand and clay. Approximately 9 g of bitumen was recovered, representing greater than 99% of all of the available bitumen in the sample of Canadian Oil Sands.

EXAMPLE 5

Separation of Bitumen Tailings Ponds MFT (Mature Fine Tailings 30% Sample 800 g of separating composition was made with River Water, as provided above in Example 4. A sample of mature fine tailings from a tailings pond in the Athabasca region of Northern Alberta province, Canada, ("MFT Pond Sample") was provided from Canada. Generally, mature fine tailings consist of an emulsion of solids (e.g., sand and clay), bitumen and water and while varying in age can be several decades old (e.g., 10 years, 20 years, 30 years, 40 years). The MFT Pond Sample contained approximately 30% solids (sand, clay and bitumen) and approximately 70% water and was thick, viscous and dark in color with a pungent odor (believed to be from the presence of anaerobic bacteria). Again, 210 g of the separating composition was utilized and this time mixed with 90 g of the MFT Pond Sample. Prior to mixing with the Canadian Oil Sands, the pH of the separating composition was adjusted to 7.8 using phosphoric acid.

The mixture of the separating composition and Canadian Oil Sands was placed into a Mason jar. The samples were heated to 140° F. (about 61° C.) using a microwave oven. After heating, in order to disperse the mixture, a 10,000 rpm high speed disperser with 1" blade was utilized. A Premier Mill, Series 2000, Model 2000, 110 V, 1 horsepower, 12 amp bench top disperser was utilized as the high speed disperser. The disperser was utilized for approximately 3 minutes.

Thereafter, as the sample sat in place the constituents settled and distinct layers began to form within about 15 minutes. Within a half hour three distinct layers had formed with bitumen in the top layer, the used separating composition in the second layer, and solids (e.g., sand and clay) in the third layer. Complete settling of the solids (and separation into distinct layers) took relatively longer than in Examples 4 and 5 due to the amount of solids (e.g., clay) present in the MFT Pond Sample.

After the Mason Jar contents had cooled and the three distinct layers had formed (approximately 12 hours), the bitumen was removed from the Mason Jar by use of a spoon (although other physical separation means such as decanting or the use of a syringe or other suction device could also be utilized). The bitumen was determined to be greater than 99% free of contaminants, including sand and clay. Approximately 2.8 g of bitumen was recovered, representing greater than 99% of all of the available bitumen in the sample of Canadian Oil Sands. The amount of bitumen recover represented approximately 3% of the weight of the MFT Pond Sample or approximately 10% of the weight of the solids present in the MFT Pond Sample.

Unless specifically stated to the contrary, the numerical parameters set forth in the specification, including the attached claims, are approximations that may vary depending on the desired properties sought to be obtained according to the exemplary embodiments. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

Furthermore, while the systems, methods, and so on have been illustrated by describing examples, and while the examples have been described in considerable detail, it is not the intention of the applicant to restrict, or in any way, limit the scope of the appended claims to such detail. It is, of course, not possible to describe every conceivable combination of components or methodologies for purposes of describing the systems, methods, and so on provided herein. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's general inventive concept. Thus, this application is intended to embrace alterations, modifications, and variations that fall within the scope of the appended claims. The preceding description is not meant to limit the scope of the invention. Rather, the scope of the invention is to be determined by the appended claims and their equivalents.

Finally, to the extent that the term "includes" or "including" is employed in the detailed description or the claims, it is intended to be inclusive in a manner similar to the term "comprising," as that term is interpreted when employed as a transitional word in a claim. Furthermore, to the extent that the term "or" is employed in the claims (e.g., A or B) it is intended to mean "A or B or both." When the applicants intend to indicate "only A or B, but not both," then the term "only A or B but not both" will be employed. Similarly, when the applicants intend to indicate "one and only one" of A, B, or C, the applicants will employ the phrase "one and only one." Thus, use of the term "or" herein is the inclusive, and not the exclusive use. See Bryan A. Garner, A Dictionary of Modern Legal Usage 624 (2d. Ed. 1995).

What is claimed is:

1. A water-based separating composition for separating hydrocarbons from hydrocarbon-containing material, said separating composition comprising:

at least about 73% by weight water;

a hydrotropic agent;

a dispersant having flocculating characteristics; and at least one acid and at least one base in amounts sufficient to provide the separating composition with a pH of about 7 to about 8.5;

wherein the hydrotropic agent and the dispersant having flocculating characteristics are different.

2. The composition of claim 1, wherein the hydrotropic agent is present in an amount of from about 0.1% to about 4% by weight of the separating composition; and the dispersant having flocculating characteristics is present in an amount of from about 0.25% to about 4.5% by weight of the separating composition.

3. The composition of claim 1, wherein the composition comprises at least about 92% by weight water.

4. The composition of claim 1 further comprising a wetting agent.

5. The composition of claim 4 wherein the wetting agent comprises an alkoxylated alcohol surfactant.

6. The composition of claim 4, wherein the wetting agent comprises 2,5,8,11-tetramethyl-6-dodecyn-5,8-diol ethoxylate.

7. The composition of claim 1, wherein the hydrotropic agent comprises a phosphorylated nonionic surfactant.

8. The composition of claim 1, wherein the hydrotropic agent comprises an aromatic phosphate ester having the formula:

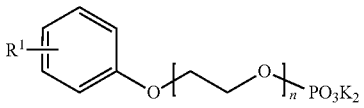

wherein $R^1$ is a $C_1$-$C_5$ linear or branched alkyl group and n=1 to 8.

9. The composition of claim 1, wherein the dispersant having flocculating characteristics comprises a phosphate salt.

10. The composition of claim 1, wherein the dispersant having flocculating characteristics comprises one or more of sodium acid pyrophosphate and tetrapotassium pyrophosphate.

11. The composition of claim 1, wherein the pH of the separating composition is from about 7.6 to about 8.5.

12. The composition of claim 1, wherein the base comprises a strong base and is present in an amount of from about 2% to about 9.5% by weight of the separating composition.

13. The composition of claim 1, wherein the composition is essentially free of organic solvent.

14. The composition of claim 1, further comprising hydrocarbon-containing material wherein the ratio of the separating composition to the hydrocarbon-containing material is from about 2:3 to about 3:2.

15. The separating composition of claim 1, wherein the acid comprises a heavy acid, and is present in an amount of from about 1.7% to about 8.6% by weight.

16. The separating composition of claim 1, wherein the acid has a specific gravity of greater than about 1.5.

17. A water-based separating composition for separating hydrocarbons from hydrocarbon-containing material, said separating composition comprising:

at least about 73% by weight water;

from about 0.1% to about 4% by weight of a hydrotropic agent; and from about 0.25% to about 4.5% by weight of a dispersant having flocculating characteristics; and at least one acid and at least one base in amounts sufficient to provide the separating composition with a pH of about 7 to about 8.5 wherein the hydrotropic agent and the dispersant having flocculating characteristics are different.

18. The separating composition of claim 17, wherein the separating composition has a pH of from about 7.6 to about 8.5.

19. The separating composition of claim 17, wherein the composition comprises at least about 92% by weight water.

20. The separating composition of claim 17 further comprising a wetting agent.

21. The separating composition of claim 17, wherein the wetting agent comprises an alkoxylated alcohol surfactant.

22. The separating composition of claim 17, wherein the wetting agent comprises 2,5,8,11-tetramethyl-6-dodecyn-5, 8-diol ethoxylate.

23. The separating composition of claim 17, wherein the hydrotropic agent comprises a phosphorylated nonionic surfactant.

24. The separating composition of claim 17, wherein the hydrotropic agent comprises an aromatic phosphate ester having the formula:

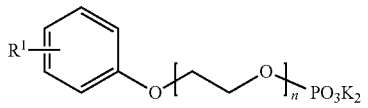

wherein $R^1$ is a $C_1$-$C_5$ linear or branched alkyl group and n=1 to 8.

25. The separating composition of claim 17, wherein the dispersant having flocculating characteristics comprises a phosphate salt.

26. The separating composition of claim 17, wherein the dispersant having flocculating characteristics comprises one or more of sodium acid pyrophosphate and tetrapotassium pyrophosphate.

27. The separating composition of claim 17, wherein the acid is a heavy acid and is present in an amount of from about 1.7% to about 8.6% by weight.

28. The separating composition of claim 17, wherein the acid has a specific gravity of greater than about 1.5 and is present in an amount of from about 1.7% to about 8.6% by weight.

29. The separating composition of claim 17, wherein the base is a strong base and is present in an amount of from about 2% to about 9.5% by weight of the separating composition.

30. The separating composition of claim 17, wherein the composition is essentially free of organic solvent.

31. The separating composition of claim 17, further comprising hydrocarbon-containing material wherein the ratio of the separating composition to the hydrocarbon-containing materials is from about 2:3 to about 3:2.

32. A water-based separating composition for separating hydrocarbons from hydrocarbon-containing material, said separating composition comprising:

at least about 73% by weight water;

from about 0.1% to about 4% by weight of a hydrotropic agent; and from about 0.25% to about 4.5% by weight of a dispersant having flocculating characteristics;

from about 1.7% to about 8.6% by weight of at least one acid; and from about 2% to about 9.5% by weight of at least one base;

wherein the separating composition is utilized at a pH of about 7 to about 8.5, the separating composition is essentially free of organic solvent and the hydrotropic agent and the dispersant having flocculating characteristics are different.

33. The separating composition of claim 32, wherein the separating composition has a pH of from about 7.6 to about 8.5.

34. The separating composition of claim 32, wherein the composition comprises at least about 92% by weight water.

35. The separating composition of claim 32 further comprising a wetting agent.

36. The separating composition of claim 32, wherein the wetting agent comprises an alkoxylated alcohol surfactant.

37. The separating composition of claim 32, wherein the wetting agent comprises 2,5,8,11-tetramethyl-6-dodecyn-5, 8-diol ethoxylate.

38. The separating composition of claim 32, wherein the hydrotropic agent comprises a phosphorylated nonionic surfactant.

39. The separating composition of claim 32, wherein the hydrotropic agent comprises an aromatic phosphate ester having the formula:

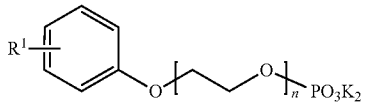

wherein $R^1$ is a $C_1$-$C_5$ linear or branched alkyl group and n=1 to 8.

40. The separating composition of claim 32, wherein the dispersant having flocculating characteristics comprises a phosphate salt.

41. The separating composition of claim 32, wherein the dispersant having flocculating characteristics comprises one or more of sodium acid pyrophosphate and tetrapotassium pyrophosphate.

42. The separating composition of claim 32, wherein the acid is a heavy acid.

43. The separating composition of claim 32, wherein the acid has a specific gravity of greater than about 1.5.

44. The separating composition of claim 32, wherein the base is a strong base.

45. The separating composition of claim 32, further comprising hydrocarbon-containing material wherein the ratio of the separating composition to the hydrocarbon-containing materials is from about 2:3 to about 3:2.

* * * * *